US008721840B2

(12) United States Patent
Peltonen et al.

(10) Patent No.: US 8,721,840 B2
(45) Date of Patent: May 13, 2014

(54) APPARATUS FOR MIXING A SUBSTANCE INTO A MEDIUM

(75) Inventors: Kari Peltonen, Kotka (FI); Arto Laukkanen, Kotka (FI); Timo Perttula, Kotka (FI); Janne Vehmaa, Siltakyla (FI)

(73) Assignee: Andritz Oy, Helsinki (FI)

( * ) Notice: Subject to any disclaimer, the term of this patent is extended or adjusted under 35 U.S.C. 154(b) by 0 days.

(21) Appl. No.: 13/577,204

(22) PCT Filed: Feb. 4, 2011

(86) PCT No.: PCT/FI2011/050098

§ 371 (c)(1), (2), (4) Date: Aug. 22, 2012

(87) PCT Pub. No.: WO2011/095697

PCT Pub. Date: Aug. 11, 2011

(65) Prior Publication Data

US 2013/0199746 A1 Aug. 8, 2013

(30) Foreign Application Priority Data

Feb. 4, 2010 (FI) ..... 20105108

(51) Int. Cl.
*D21F 1/00* (2006.01)

(52) U.S. Cl.
USPC ..... 162/232

(58) Field of Classification Search
USPC ..... 162/232, 262, 243, 246; 366/160.1, 366/167, 176.2, 152.1, 151, 150.1; 210/760; 48/180.1; 239/128, 75
See application file for complete search history.

(56) References Cited

U.S. PATENT DOCUMENTS

| | | | |
|---|---|---|---|
| 3,734,111 | A | 5/1973 | McClintock |
| 6,361,025 | B1 | 3/2002 | Cincotta et al. |
| 7,621,512 | B2 | 11/2009 | Brockman |

FOREIGN PATENT DOCUMENTS

| | | |
|---|---|---|
| DE | 1 704 754 | 5/1971 |
| DE | 199 02 610 | 6/2000 |
| EP | 1 319 435 | 6/2003 |

OTHER PUBLICATIONS

DE 199 02 610, machine traslation, Brockmann, Gerhard, 2000.*
EP 1 319 435, machine translation, Gasser, Hermann, 2003.*
European Search Report completed Jun. 6, 2011.

* cited by examiner

*Primary Examiner* — Mark Halpern
(74) *Attorney, Agent, or Firm* — Nixon & Vanderhye P.C.

(57) ABSTRACT

The invention relates to an apparatus for mixing a gaseous or liquid substance into fiber suspension. The apparatus includes a tubular body, which defines a space that forms a flow channel for the suspension, in which body an inlet and an outlet for the suspension are arranged so that the suspension flows through the flow channel mainly in the axial direction. Further the apparatus comprises a feed member that extends into the flow channel transversely against the flow direction of the suspension and has a cylindrical wall provided with openings for leading the substance from the feed member into the flow channel. At least one protrusion is arranged on the inner surface of the tubular body in the region the feed member. A throttling member is arranged in the flow channel downstream of the feed member in the flow direction of the suspension, and a mixing chamber is formed in the flow channel between the feed member and the throttling member.

17 Claims, 5 Drawing Sheets

APPARATUS FOR MIXING A SUBSTANCE INTO A MEDIUM

RELATED APPLICATION

This application is the U.S. national phase of International Application No. PCT/FI2011/050098 filed 4 Feb. 2011 which designated the U.S. and claims priority to Finnish Application No. 20105108 filed 4 Feb. 2010, the entire contents of each of which are hereby incorporated by reference.

BACKGROUND

The present invention relates to an apparatus for mixing both liquid and gaseous substances, such as chemicals, into a medium formed of solid and liquid substance, especially to fiber suspensions being generated during processing of wood or other vegetable-originating substance. To this kind of suspensions typically belong the fiber suspensions of the pulp and paper industry, such as chemical pulp and mechanical pulp suspensions, as well as pulp suspensions of paper production.

For mixing chemicals and gases into fiber suspensions, dynamic mixers are used, which typically are provided with a rotating rotor for effecting the mixing, and static mixers. In the latter, some sort of throttling has been arranged in the flow channel, where the flow rate is increased and the static pressure is decreased. Chemical is introduced into a lower static pressure zone or it can be introduced upstream of the point of throttling. In a static mixer, by throttling the flow, i.e. decreasing the cross-sectional area, an increase in the flow rate is achieved and due to the throttling and the shape of the flow channel a higher turbulence is generated, whereby the introduced chemical will mix into the actual flowing medium. Static mixers are typically provided with, in addition to or alternatively to the throttling, flow barriers arranged in the flow channel for generating turbulence.

Fiber suspension is a demanding material flow in view of mixing, because in order to obtain a good mixing result the fiber network (fiber flocks) are to be decomposed. In the mixing, the turbulence is to be at a level that decomposes the fiber flocks into microflocks and individual fibers, whereby the bleaching chemical is made to be distributed in the vicinity of the individual fibers. Traditionally, with medium consistency fiber suspensions high-capacity fluidizing chemical mixers have been used, wherein the rotor of the mixers generates the turbulence required for the mixing. Although modern fluidizing chemical mixers are reasonably small, intensifying energy consumption creates needs to decrease the amount of energy used for mixing chemicals.

The operation of static mixers is based on utilizing the pressure loss taking place in the apparatus and/or dividing the suspension flow into partial flows and combining them in the flow direction so that the concentration differences upstream of the mixer will be equalized.

European patent 1469937 (WO 03/064018) describes an apparatus for admixing a gas or a liquid into a material flow. In this apparatus a tube with a circular cross section is provided with a chamber for the material flow. The chamber has an inlet part, the cross section of which later changes from circular to oval while the area remains unchanged and an outlet part, the cross section of which later changes from oval to circular while the area remains unchanged. Gas or liquid is fed into the material flow at the narrowest point of the apparatus, which is provided with e.g. small circular holes around the chamber. The change of the material flow from laminar to turbulent state takes place when the minimum height of the oval cross section is defined in a proper way. The gas or the liquid is added in the turbulent zone.

For adding steam into a fiber suspension, direct heat injection heaters are used. In those the steam is admixed directly into a flowing fiber suspension to be heated, whereby the heating takes place quickly. Although direct steam injection heaters are efficient, fiber suspensions with flocking matter tend to clog the heater, if the suspension is to flow through bends and turns. U.S. Pat. No. 6,361,025 describes a direct steam injection heater that is designed for viscose material flows, such as fiber suspension, and in which the steam is introduced into the suspension flowing axially through a tube. In the construction according to U.S. Pat. No. 6,361,025 steam feed takes place in a cylindrical perforated part mounted through the device. The number of open holes can be regulated by means of a cover located inside the cylindrical tube, by means of which the steam feed can be totally closed if needed and also the passing of pulp to the interior of the cover or further into the steam feed piping can be prevented. The perforated cylindrical pipe, referred to as a Mach-diffuser, is mounted transversely with respect to the axial flow of the suspension, whereby it divides the flow space into two parts. Small jets of steam are easily scattered in a viscose suspension and distributed before the steam has a possibility to combine into large bubbles which may generate pressure shocks as steam is suddenly condensed. The smaller the bubbles of the condensing steam, the smaller is the pressure shock caused for the piping. Condensing of a large steam bubble on the inner surface of the pipe causes a strong pressure shock and noise and strong mechanical vibration in the piping. The cover is preferably rotatable with respect to the longitudinal axis of the Mach-diffuser mounted transversely with respect to the flow of the suspension. When the cover is rotated open, holes are freed both from the upper and the lower side, wherethrough the steam flows into the by-passing pulp.

The direct steam injection heat exchanger of the above-mentioned US-patent is advantageous as a steam feeding device, because the steam is fed via several small holes into the by-flowing pulp. As long as the pressure drop across the small open steam holes is adequate, the flow of the steam into the suspension remains even. When the velocity of the steam is adequately high, even condensing of the steam is obtained due to high turbulence caused by the steam feed. The steam condenses evenly, as the condensing takes place near the feed point.

When the pressure loss generated in a static mixer is utilized for effecting the mixing, the mixing result often varies depending on the pressure loss. If a static mixer is based on dividing and combining partial flows, the mixing result is not proportional to the generated pressure loss. A possible problem in this type of devices may be clogging of the partial flow channels and clear deterioration of the mixing efficiency, in addition to an increased pressure loss.

Based on the above, when treating fiber suspensions, the static mixer should break the fiber network, preferably fluidize the through-flowing suspension to an adequate extent, and the mixing result should not be dependent on the generated pressure loss, and partial clogging of the device should not affect the mixing result. In the designing of a device for mixing fiber suspension attention is to be paid to the possibility of ensuring the functioning condition of the device even if the suspension has been thickened e.g. due a disturbance situation at the mill. This means that when the mixer is taken into use it will reach an adequate operational level at the same time as the chemical feed is initiated. If a pressure loss generated in the device is utilized for generating turbulence in static mixers, but it is still desired to limit the extent of the pressure loss, the chemical feed is to be as even as possible with respect to the flow cross-sectional area.

In addition to steam or other gas, it is necessary to introduce into the fiber suspension flow also one or more liquid chemicals, such as bleaching chemical, which has to be distributed and mixed efficiently into the fiber suspension in order to ensure adequately quick and efficient reactions between the suspension and the chemical. For instance the above described apparatus presented in U.S. Pat. No. 6,361,025 and manufactured by Hydro-Thermal Co. has been found an advantageous steam feeding apparatus. However, the mixing capability of static mixers to e.g. mix bleaching chemicals into a fiber suspension should be improved.

SUMMARY OF INVENTION

An apparatus has been conceived to improve the mixing efficiency of static mixers so that they can be used for adding and mixing various gaseous and liquid chemicals and other substances into a fiber suspension.

If the introduction of the chemical into a by-flowing suspension is even, less turbulence/energy is needed in order to achieve good mixing results.

An apparatus has been conceived for admixing a gaseous or liquid substance into a fiber suspension, said apparatus comprising a tubular body defining a space that forms a flow channel for the suspension, in which body the suspension flows through the flow channel mainly in the axial direction, a tubular feed member extending into the flow channel transversely against the flow direction of the suspension, comprising a conduit line for leading the substance into the feed member and having a cylindrical wall provided with openings for leading the substance from the feed member into the flow channel, at least one protrusion that is arranged on the inner surface of the tubular body in the region of the feed member, a throttling member that is arranged in the flow channel downstream of the feed member in the flow direction of the suspension, and a mixing chamber formed in the flow channel between the feed member and the throttling member.

The substance being fed into the suspension comprises steam, water, oxygen, chlorine dioxide or other gaseous or liquid substance that is required for treating the fiber suspension. In connection with the description of the invention this substance will in the following be referred to as chemical, although the invention is not specifically limited to a certain substance.

The conduit line of the feed member for a chemical or corresponding substance is connected to a pressurized source for maintaining a higher pressure in the feed member than in the suspension flow channel. The gaseous or liquid substance, such as chemical, penetrates into the by-flowing fiber suspension to a distance proportional to the pressure difference between the feed member (chemical line) and the suspension line. By limiting the height of the flow cross-sectional area between the tubular feed member and the body of the apparatus by means of a protrusion, the chemical is made to distribute evenly into the by-flowing suspension and simultaneously the velocity of the by-flowing suspension is increased to a desired level. The height, H, of the flow cross-sectional area between the feed member and the body of the apparatus is the shortest distance, H, of at least one protrusion arranged on the inner surface of the tubular body, from the outer surface of the feed member's cylindrical outer wall: $H=k*dp$, where k is (0.004 . . . 0.012)/100 [m/kPa] and dp [kPa] is the pressure difference between the conduit line for the substance and the suspension flow channel. In other words, k is in the range of 4 . . . 12 mm/bar, when dp pressure difference is expressed in bars. Thus, the purpose of the protrusion arranged on the inner surface of the tubular body in the region of the feed member is first and foremost the lowering of the height of the flow channel.

According to an embodiment, the height of the protrusion is constant in the longitudinal direction of the protrusion. According to another embodiment, the height of the protrusion changes in the longitudinal direction of the protrusion.

For improving the mixing efficiency of a static mixing apparatus it is advantageous to provide the apparatus with throttling that is adequately far apart from the chemical feed point in the flow direction of the suspension. The throttling member is arranged in the flow channel downstream of the feed member at a distance L from a plane that is perpendicular to the flow direction of the suspension and passes through the center point of the feed member. The decrease of the flow cross-sectional area by means of the throttling member is preferably 40-70%. In addition to the throttling being at a sufficient distance from the chemical feed, it is also preferably positioned asymmetrically with respect to the flow. The throttling limits the jets that are formed on both sides of the feed member tube, thus intensifying the mixing operation. When the throttling is made asymmetric, a mixing chamber is formed between the feed member tube and the throttling, in which chamber the flow turbulences homogenize the concentration differences of the chemical or corresponding substance. The distance L of the throttling member is preferably $a*H$, whereby a is in the range of 3-8 and H is the above described distance. At its simplest, the throttling member can be a plate with a circular opening, but more preferably the opening is elliptic or a combination of a circular and elliptic shape or a rectangle or a combination of a circle and a rectangle, with rounded corners. The throttling member can also be a part of the flow channel having a length of $0.02\text{-}2.0*D$, where D is the diameter of the channel upstream of the throttling. When the length of the throttling member is $0.2\text{-}2.0*D$, the throttling channel preferably widens in the flow direction so that the cross-sectional area of the channel is at its smallest in the part of the throttling member that is closest to the mixing chamber, i.e. the cross-sectional area increases in the direction of the flow.

Thus, factors that are critical in view of the mixing are good penetration of the chemical into the by-flowing suspension, which is controlled by means of pressure difference between the chemical line and the suspension line and the height of the flow channel at the feed point (the feed member) of the chemical. At the same time as the lowering of the flow channel allows the penetration of the chemical into the by-flowing suspension it accelerates the suspension to a velocity at which the mixing chamber formed between the feed point and the throttling is made to operate in a desired way. A characteristic feature of this kind of static mixer is two separate jet flows located on opposite sides of the feed member. It is advantageous that both the jet flows and the throttling limiting the mixing chamber are asymmetric. Additionally, the inner surface of the mixing chamber can be formed so that an advantageous effect on the flow is achieved. For this purpose, the mixing chamber can be provided with means or parts required for guiding the flow, which preferably can comprise ribs, blades, roundings of the surface, elliptical parts, and other protruding parts.

Especially when mixing gas-containing chemicals, asymmetric throttling is preferably effected in the upper part of the flow channel, whereby the chemical to be mixed is not allowed to accumulate in the mixing chamber, but exits with the main flow. That way, a desired dose of chemical to be mixed is always admixed into the suspension flow.

In view of the jet flows this means that the flow channel parts formed on both sides of the feed member are preferably of different height, i.e. they have different heights H and H1. In that case, when the jet flows collide the throttling, the flow that is generated is as turbulent as possible.

The feed member is not movable during operation, but preferably an annular closing member is provided on the inner side of a cylindrical wall of the feed member, said closing member being movable with respect to the feed member and having a cylindrical wall and at least one opening therein, which is set to face openings in the wall of the feed member, whereby the substance is allowed to flow into the suspension. The closing member allows covering a desired portion of the openings in the feed member for dosing a required amount of chemical into the suspension. According to an embodiment, the cross-section of the feed member is elliptic and the feed openings for the substance are located at the narrowest point of the feed member, and the wall of the closing member is provided with protrusions that extend to the feed openings of the feed member. The different cross sections of the feed member (elliptic) and the closing member (circular) make it possible to rotate the closing member provided with protrusions inside the feed member, whereby the protrusions of the closing member remove fibers etc. solid matter that has possibly passed into the openings from the suspension. This kind of construction allows cleaning and maintaining the chemical flow at all feed points for the chemical.

The static mixing apparatus according to the present invention is suitable especially for fiber suspensions of the wood processing industry and other vegetable-originating fiber suspensions. Thereby the mixing device operates preferably within consistency ranges 1-12%.

SUMMARY OF DRAWINGS

The invention is described in more detail with reference to the accompanying Figures, of which

DETAILED DESCRIPTION

Figure 1A:
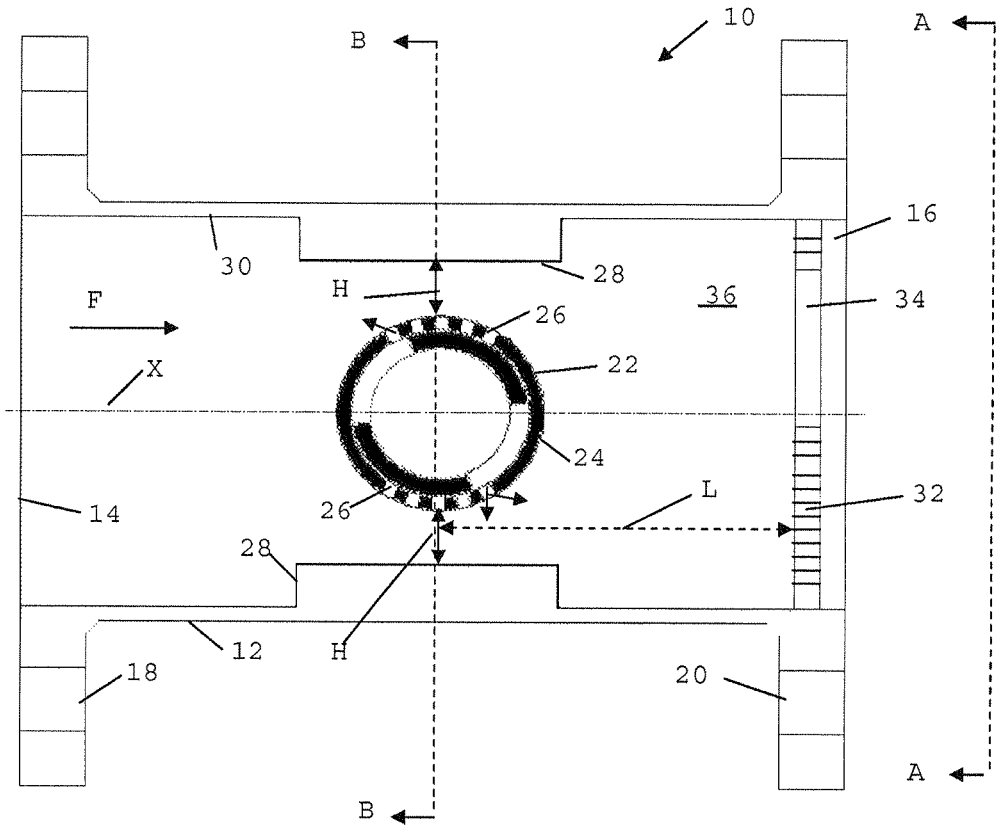
FIGS. 1*a* and 1*b* are side views illustrating a longitudinal cross section of an apparatus according to a preferred embodiment of the invention.

FIG. 1 illustrates a mixing apparatus 10 which comprises a tubular body 12 that defines a space forming a flow channel for the suspension in the mixing apparatus. It has a suspension inlet 14 and a suspension outlet 16 with flanges 18 and 20. The longitudinal axis of the tubular body is marked with X. The suspension flows essentially in the direction of the axis X. The mixing apparatus 10 is attached at its flange 18 to the inlet piping for incoming fiber suspension and at its flange 20 to the discharge piping for fiber suspension exiting the mixer (not shown).

The tubular body 12 is provided with a tubular feed member 22 that extends into the flow channel transversely against the longitudinal axis X of the tubular body and also against the flow direction F of the suspension. The feed member has a cylindrical wall 24 with through openings 26 for leading a substance from the member into the suspension flow channel. Openings 26 in an adequate number are provided in both the circumferential and axial direction of the feed member wall. The openings 26 are located in the circumferential direction preferably only on a predetermined portion of the wall. Openings 26 are preferably provided only on those parts of the wall that are directed towards the inner surface 30 of the tubular body and thus towards the protrusions 28 therein. The wall portions of the tubular member, which are directed towards the suspension flow direction, i.e. upstream and downstream, are preferably devoid of openings.

Figure 1B:
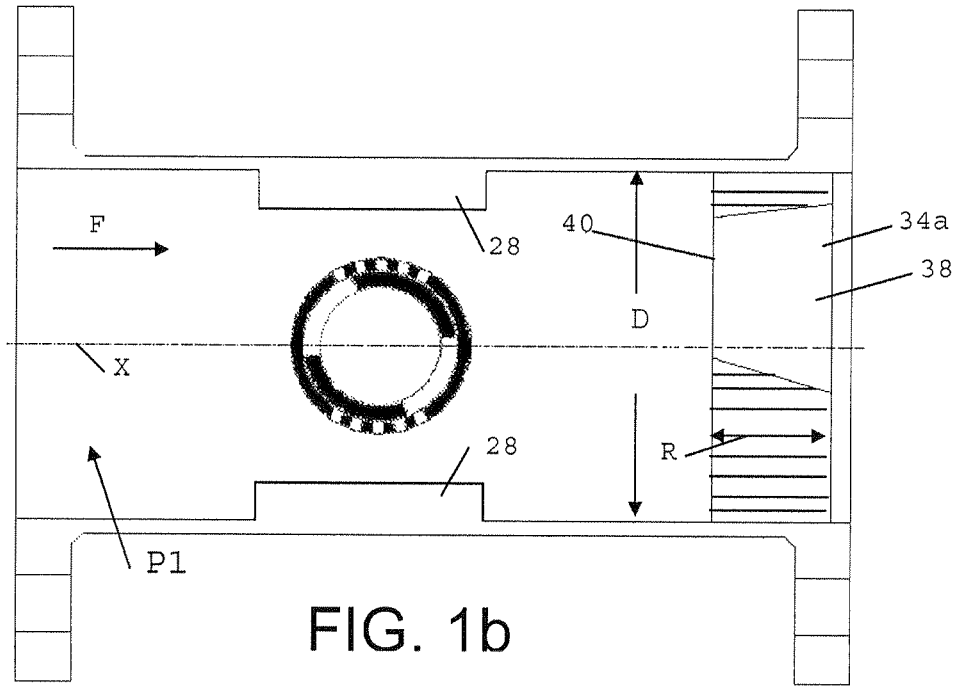

The apparatus comprises protrusions 28 that are arranged on the inner surface/inner circumference 30 of the tubular body in the region of the feed member. Thus, the protrusions are located at the feed member so that the height of the flow channel can be lowered. In the tubular body the cross-sectional area of the flow channel remains essentially the same upstream and downstream of said protrusions 28 in the flow direction of the suspension. By limiting the height of the flow cross-sectional area between the tubular feed member and the body of the apparatus by means of a protrusion, the chemical is made to distribute evenly into the by-flowing suspension and simultaneously the velocity of the by-flowing suspension is increased to a desired level. It has been found that the mixing efficiency is influenced by the height of the channel between the feed point 22 and the body of the apparatus, which height in FIG. 1 is marked with a letter H. The height H of the channel depends on the pressure difference between the chemical line and the suspension line and preferably H is k*d, where k is in the range of (0.004–0.012)/100 [m/ka] and d [ka] is the pressure difference between the feed line for the substance and the flow channel for the suspension (dp=p2–p1; p2 and p1 have been illustrated in FIG. 6 and FIG. 1*b*, respectively). This way, the feed member divides the flow channel for the suspension into two parts having an equal height, H, or different heights.

The length of the protrusion 28 in the longitudinal direction X of the tubular body is preferably at least the length of the diameter of the feed member 22. When seen in the flow direction of the suspension, the cross section of the protrusion is typically a segment of a circle. In the direction of the circumference of the tubular body the protrusion extends to a certain distance, which is determined for each case mainly by the height H required for the flow channel.

The protrusion may be an integral part of the tubular body construction, as illustrated in FIG. 1, or it may be a separate part that is separately attached on the inner circumference of the tubular body. In the latter case the attaching be effected even afterwards or protrusions can even be replaced due to wear or due to a desire to change their size.

An essential characteristic of an embodiment of the invention is the decreasing of the flow cross-sectional area downstream of the feed point by means of a throttling member, such as a throttling plate. In FIG. 1*a* the throttling plate 32 is positioned at a distance, L, from a plane T that passes through the center point of the feed member and is perpendicular to the flow direction of the suspension, for narrowing the flow cross-sectional area, and the distance L is a*H, where a=3-8 and H is the shortest distance of at least one protrusion 28 arranged on the inner surface of the tubular body from the outer surface 24 of the cylindrical wall of the feed member 22.

Further, when studying the effect of the decrease in the flow cross section on the mixing efficiency it has been found that it has two substantial factors relating to the throttling point. Preferably the decrease in the cross-sectional area is to be 40 . . . 70% and preferably it is to be asymmetrical with respect to the center line X of the apparatus. Preferably at least 60% of the change in the cross-sectional area is on one side of the center line X. In the embodiment illustrated in FIG. 1*a* the outlet 34 for the suspension is located mainly above the center line X of the apparatus.

A mixing chamber 36 is formed in the space between the feed member tube (feed point) and the throttling, the length L of which chamber is preferably a*H, where a is between 3 and 8 and H is the height of the channel at the feed point, as described in the above. In the parts of the flow channel on both sides of the feed member tube, favorable conditions generate suspension jets. Throttling 32 after the feed member limits these jets generated on both sides of the feed member tube, thus intensifying the mixing operation. In the mixing chamber 36 the flow turbulences homogenize the concentration differences of the chemical or corresponding substance. Making the throttling asymmetric and thus intensifying the mixing is highly advantageous.

In FIG. 1*a* the height of the protrusion 28 is constant, i.e. the distance of its planar outer surface from the inner circumference of the tubular body does not change in the longitudinal direction of the protrusion (in the direction of the longitudinal axis X of the tubular body). The outer surface may also be referred to as guiding surface of the protrusion, because it guides the flow of the suspension and thus assists the mixing operation.

As mentioned in the above, the throttling member 32 can at its simplest be a plate, typically having a thickness of 10-20 mm. In that case it has a circular opening 34, but more preferably the opening is elliptic or a combination of a circular and elliptic shape or a rectangle or a combination of a circle and a rectangle with rounded corners. FIG. 1*b* illustrates a second embodiment. The throttling can also be a part 38 of the flow channel having a length R of 0.02-2.0*D, where D is the diameter of the tubular body upstream of the throttling. When the length R of the throttling channel (the thickness of the throttling member) is 0.2-2.0*D, the throttling channel 38 preferably widens in the flow direction F of the suspension (opening 34*a*) so that the cross-sectional area of the throttling channel is at its smallest in the part 40 of the throttling member that is closest to the mixing chamber 36. Thus, the cross-sectional area of the throttling channel increases in the flow direction of the suspension.

Figure 2:
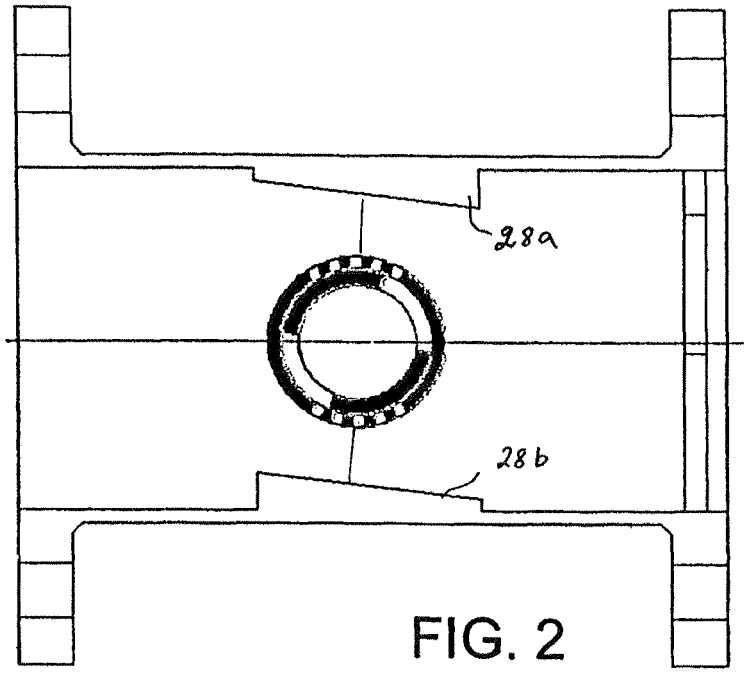
FIG. 2 is a side view illustrating a longitudinal cross section of an apparatus according to a second preferred embodiment of the invention.

FIG. 2 illustrates an alternative shape of the protrusion. In this case also the shapes of the protrusions located on different sides of the feed member are different from each other. The height of each protrusion changes in the longitudinal direction of the protrusion (in the direction of the longitudinal axis X of the tubular body), but the distance of the planar outer surface 30*a* of the protrusion 28*a* from the inner circumference 30 of the tubular body towards the center of the body increases in the longitudinal direction of the protrusion (in the direction of the longitudinal axis X of the tubular body). The distance of the planar outer surface 30*b* of the second protrusion 28*b* from the inner circumference 30 of the tubular body towards the center of the body, in its turn, decreases in the longitudinal direction of the protrusion (in the direction of the longitudinal axis X of the tubular body).

The embodiment of FIG. 2 can also be effected reversed so that the distance of the planar outer surface 30*a* of the protrusion 28*a* from the inner circumference 30 of the tubular body towards the center of the body decreases in the longitudinal direction of the protrusion, and the distance of the outer surface 30*b* of the protrusion 28*b* increases.

Figure 3:
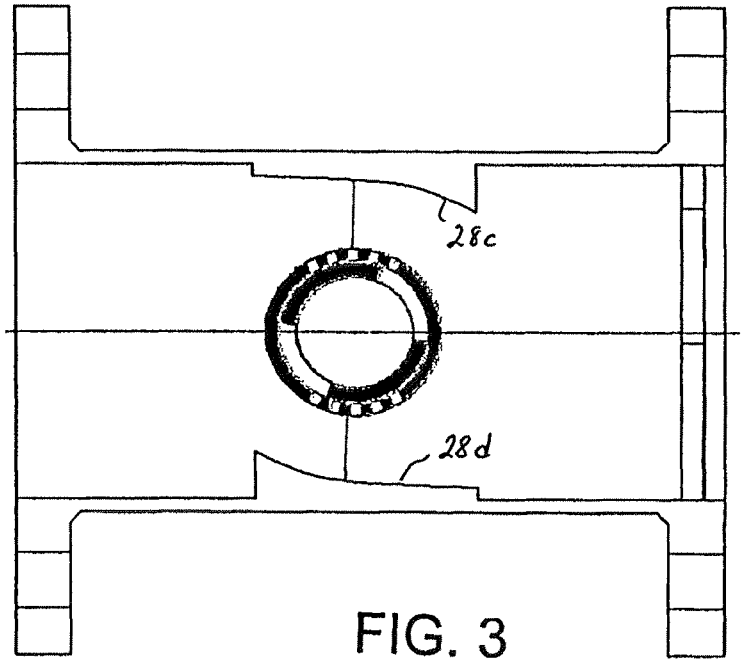
FIG. 3 is a side view illustrating a longitudinal cross section of an apparatus according to a third preferred embodiment of the invention.

FIG. 3 illustrates a further alternative shape of the protrusion. In this case the distance of the outer surface 30*c* of the protrusion 28*c* from the inner circumference 30 of the tubular body towards the center of the body increases in the longitudinal direction of the protrusion, but the outer surface 30*c* is not planar, but curved. The distance of the planar outer surface 30*d* of the second protrusion 28*d* from the inner circumference 30 of the tubular body towards the center of the body, in its turn, decreases in the longitudinal direction of the protrusion, but it has a curved outer surface, too.

Figure 4:
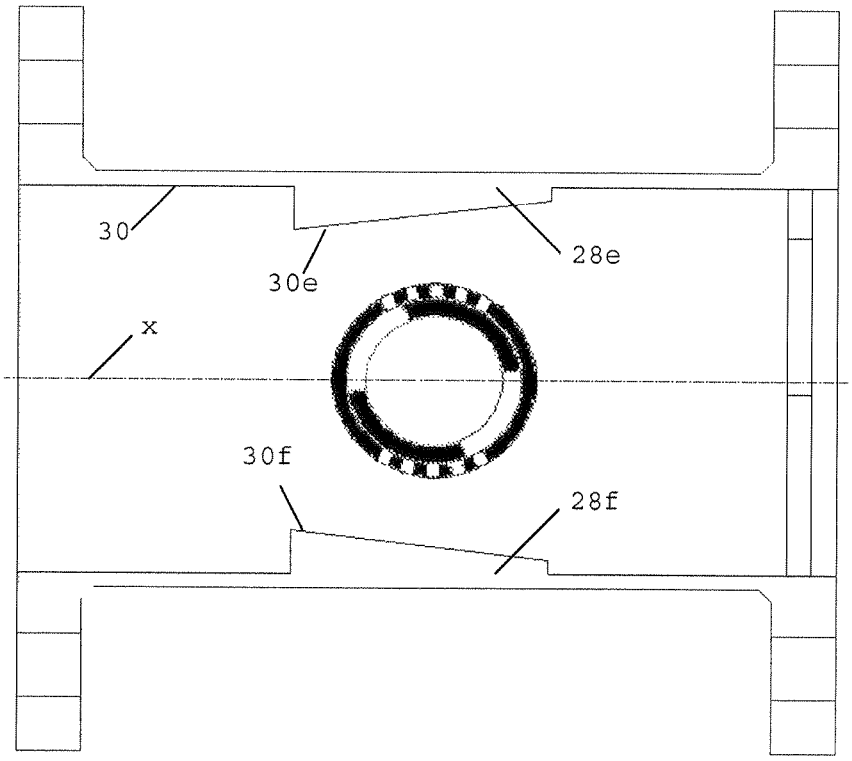
FIG. 4 is a side view illustrating a longitudinal cross section of an apparatus according to a fourth preferred embodiment of the invention.

In the embodiment according to FIG. 4 the protrusions 28*e* and 28*f* are symmetrical so that the height of both protrusions changes in the longitudinal direction of the protrusion (in the direction of the longitudinal axis of the tubular body) and so that the distance of the outer surfaces 30*e*, 30*f* of the protrusions from the inner circumference 30 of the tubular body towards the center of the body increases in the longitudinal direction of the protrusion.

The shapes of the outer surface of the protrusions of FIGS. 1-4, arranged on the inner surface of the tubular body, all provide beneficent mixing. The protrusion of uniform height illustrated in FIGS. 1*a* and 1*b* is the simplest to produce and thus the most advantageous.

The feed channel parts of FIGS. 1-4 that are formed on both sides of the feed member are according to an embodiment preferably of different height, i.e. they have different heights H and H1. In that case, when the jet flows collide the throttling, the flow that is generated is as turbulent as possible.

Figure 5:
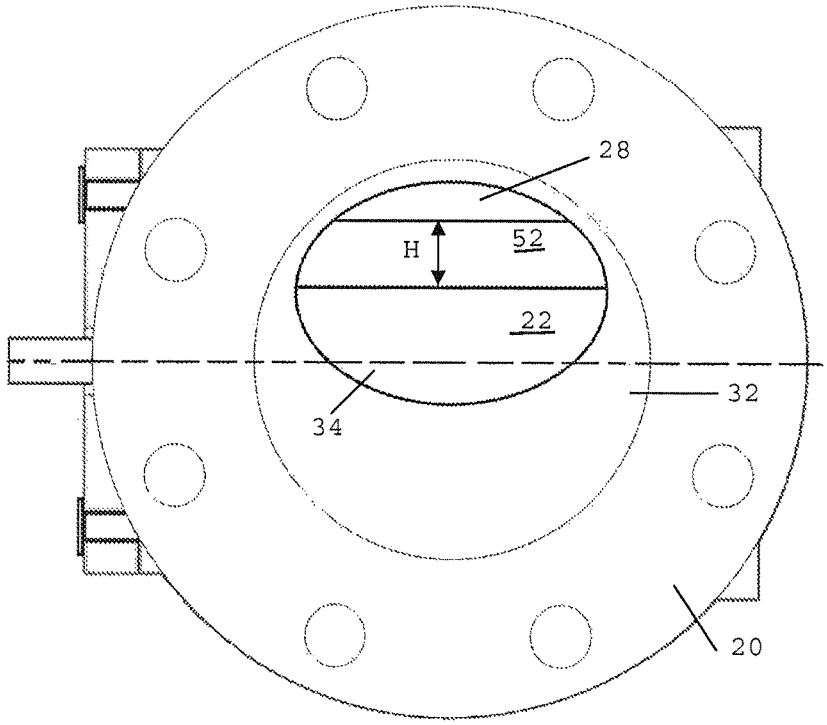
FIG. 5 is a cut view along section A-A of the embodiment of FIG. 1.

FIG. 5 illustrates a mixing apparatus according to an embodiment of the invention seen from the outlet for the suspension. Located foremost are a flange 20 and a throttling plate 32, wherein the outlet 34 for the suspension flow is elliptic. Between the feed member 22 and the planar outer surface of the protrusion 28 a flow channel portion 52 is formed having a height H. More preferably the opening 34 is elliptic or a combination of a circular and elliptic shape or a rectangle or a combination of a circle and a rectangle, where the corners are rounded.

Figure 6:
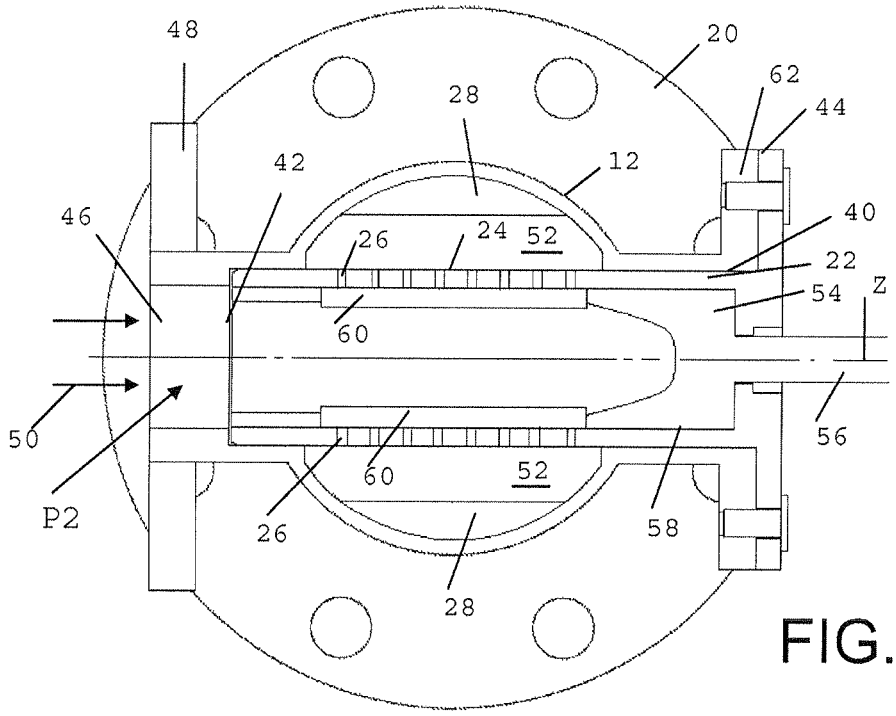
FIG. 6 is a cut view along section B-B of the embodiment of FIG. 1.

FIG. 6 illustrates in side view the longitudinal section (longitudinal axis Z) of the feed member 22 as mounted transversely in the tubular body 12, wherethrough the suspension flows axially. The longitudinal axis Z of the feed member is transversely against the longitudinal axis of the tubular body 12. One end 40 of the cylindrical wall 24 of the feed member 22 is attached to the tubular body 12, while the other end 42 of the cylindrical wall is open. The end 40 of the cylindrical wall of the feed member extends in the axial direction in the form of a flange-like basic plate 44 that is attached to a flange 62 extending from the tubular body 12. A conduit 46 and a flange 48 are connected to the tubular body 12 in the direction of its radius, to which flange a feed pipe (not shown) for chemical or other substance is connected. The open end 42 of the feed member sits in the inner part of said conduit 46. Through the opening 42 of the open end the chemical (arrow 50) is led into the interior of the feed member 22, the wall of which is provided with openings 26, through which the chemical is led into the suspension in channel 52.

Inside the cylindrical wall 24 of the feed member 22 a closing member 54 is provided, whereto a shaft 56 or corresponding is connected, which in its turn is connected to an actuator (not shown) for moving the closing member around the longitudinal axis Z of the feed member. According to an embodiment, the closing member is formed of a cylindrical wall 58 provided with at least one opening 60. FIG. 6 illustrates two openings 60, which are set to face the openings 26 of the feed member so that a required amount of chemical can flow and get mixed into the suspension. Thus, the closing member is used to cover a desired number of openings 26 for regulating the amount of chemical.

The openings 26 in the feed member can be holes or slots. We have discovered that for liquid chemicals the diameter of an individual hole is preferably bigger than 2.0 mm, more preferably 3-6 mm. If the chemical is fed through slot-like openings instead of holes, the width of the slot is to be more than 2.5 mm, more preferably 3-6 mm. The length is preferably 20-40 degrees in the direction of the circumference of the cylindrical wall of the feed member.

Figure 7A:
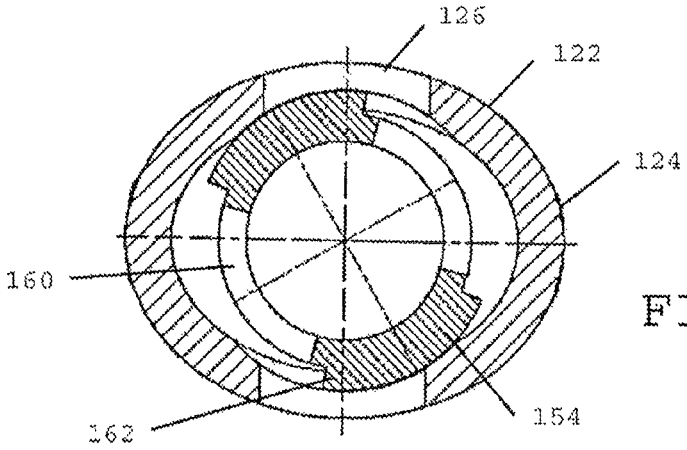
FIGS. 7*a* and 7*b* illustrate in more detail a preferred construction of the feed member and the closing member.
Figure 7B:
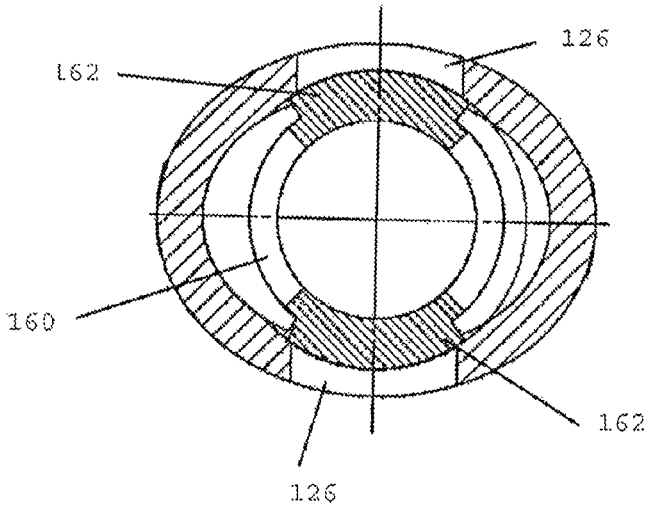

FIG. 7 illustrates a cross section of the construction of a feed member 122 according to an embodiment of the invention and a closing member 154 located inside said feed member. The cross section of the cylindrical wall 124 of the feed member 122 is elliptic and the inlet openings 126 for the substance are located at the narrowest point of the feed member. The cross section of the closing member 154 located inside the feed member is instead essentially circular. Openings 160 are also provided in the wall of the closing member, which openings are set to face the openings 126 of the feed member by moving the closing member, whereby the chemical is allowed to flow out of the feed member into the suspension surrounding it. At least one protrusion 162 is provided in the wall of the closing member 154, which protrusion extends in the radial direction partly into the interior of the inlet opening 126 when said opening is closed (FIG. 7*b*). The different cross sections of the feed member (elliptic) and the closing member (circular) make it possible to rotate the closing member provided with protrusions inside the feed member, whereby the protrusions 162 of the closing member remove fibers etc. solid matter that has possibly passed into the openings 126 from the suspension. This kind of construction allows cleaning and maintaining the chemical flow at all feed points for the chemical.

In the treatment of fiber suspension, dynamic mixers have typically been used, which have a rotating rotor for effecting the mixing. The static apparatus according to an embodiment of the invention provides for following advantages:

- efficient mixing during the addition of various treatment substances into a fiber suspension
- an advantage of a static mixing apparatus is that the installation will be simplified, as no drive (motor) is needed and the instrumentation is simpler
- decreased total energy consumption
- lower investment costs The present invention is not limited to the above presented embodiments, but various modifications are possible within the scope defined by the claims.

The invention claimed is:

1. An apparatus for admixing a gaseous or liquid substance into a fiber suspension, said apparatus comprising:

a tubular body defining a space that forms a flow channel for the suspension, the body includes an inlet and an outlet for the fiber suspension arranged to allow the suspension to flow through the flow channel in an axial direction, a tubular static feed member extending into the flow channel transversely against a flow direction of the suspension, the tubular feed member comprising a conduit configured to direct the gaseous or liquid substance into the feed member and having a cylindrical wall provided with openings for feeding the gaseous or liquid substance from the feed member into the flow channel, at least one protrusion arranged on an inner surface of the tubular body proximate to the feed member, a throttling member arranged in the flow channel downstream of the feed member in the flow direction of the suspension, and a mixing chamber in the flow channel between the feed member and the throttling member, wherein the tubular feed member is attached to the tubular body.

2. The apparatus according to claim 1, wherein the shortest distance (H) between the protrusion and an outer surface of the cylindrical wall of the feed member is k times dp, where k is in a range of (0.004 to 0.0012)/100 [m/kPa] and dp [kPa] is a pressure difference between the feed line for the gaseous or liquid substance and the flow channel for the suspension.

3. The apparatus according to claim 2, wherein the throttling member is arranged at a distance (L) from a plane that is perpendicular to the flow direction of the suspension and passes through a center of the feed member for narrowing the flow cross-sectional area and the distance (L) is a times H, where a is in a range of 3 to 6.

4. The apparatus according to claim 1, wherein the throttling member decreases the flow cross-sectional area asymmetrically with respect to a longitudinal central axis of the tubular body.

5. The apparatus according to claim 4, wherein the asymmetrical throttling is achieved by an opening in the throttling member primarily in an upper part of the flow channel.

6. The apparatus according to claim 1, wherein the throttling member is in a portion of the flow channel with a length (R) in a range of 0.2 to 2.0 times D, where D is the diameter of the flow channel upstream of the throttling member, and the cross-sectional area of the throttling channel increases in the flow direction.

7. The apparatus according to claim 1, wherein the throttling member decreases the flow cross-sectional area in a range of 40 percent to 70 percent.

8. The apparatus according to claim 1, wherein the distance between the feed member on an upper region of the channel differs from the feed member on a lower region of the channel.

9. The apparatus according to claim 1, wherein a closing member is provided inside the cylindrical wall of the feed member, said closing member being movable with respect to the feed member and having a cylindrical wall and at least one opening therein.

10. The apparatus according to claim 9, wherein the feed member has an elliptic shape in cross section and the inlet openings for the substance are located at a narrowest point of the feed member and the wall of the closing member is provided with at least one protrusion that extends into the inlet opening of the feed member.

11. The apparatus according to claim 1, wherein the protrusion has a constant height in the longitudinal direction of the protrusion.

12. The apparatus according to claim 1, wherein the protrusion has a height that varies in the longitudinal direction of the protrusion.

13. An apparatus for mixing a gaseous or liquid substance into a fiber suspension, said apparatus comprising:

a tubular body defining a space that forms a flow channel for the suspension, the body includes an inlet and an outlet for the fiber suspension arranged to allow the suspension to flow through the flow channel in a flow direction, a tubular static feed member extending into the flow channel transversely to the flow direction, the tubular feed member including a conduit configured to direct the gaseous or liquid substance into the feed member and having a cylindrical wall provided with openings for feeding the gaseous or liquid substance from the feed member into the flow channel, at least one protrusion arranged on an inner surface of the tubular body proximate to the feed member, a throttling member arranged in the flow channel downstream of the feed member in the flow direction of the suspension, and a mixing chamber in the flow channel between the feed member and the throttling member, wherein the tubular feed member is attached to the tubular body.

14. The apparatus of claim 13 wherein the at least one protrusion has a length in the flow direction commensurate with a width of the feed member in the flow direction.

15. The apparatus of claim 13 wherein the at least one protrusion is aligned with the openings in the tubular feed member in a direction orthogonal to the flow direction.

16. The apparatus of claim 13 wherein a distance between the protrusion and the tubular feed member is shorter on one side of the flow channel than on an opposite side of the flow channel.

17. The apparatus of claim 13 wherein the throttling member includes a plate mounted in the flow channel to substantially direct the fiber suspension through at least one opening in the throttling member, wherein the at least one opening is offset from an axis of the flow channel.

* * * * *